United States Patent [19]

Moiroux et al.

[11] 3,986,796

[45] Oct. 19, 1976

[54] DIRECT ACTION COMPRESSOR FITTED WITH A ONE-PIECE PISTON

[76] Inventors: Auguste F. Moiroux, 28 route de Dardilly, Ecully, Rhone; Francois Bernard, 105 cours du Docteur Long, Lyon 3°, Rhone, both of France

[22] Filed: Mar. 19, 1975

[21] Appl. No.: 560,002

Related U.S. Application Data

[63] Continuation-in-part of Ser. No. 377,010, July 6, 1973, abandoned.

[30] Foreign Application Priority Data

July 6, 1972 France ..... 72.25175

[52] U.S. Cl. ..... 416/364; 417/380; 417/396; 123/46 R; 123/46 SC

[51] Int. Cl.[2] ..... F02B 71/00; F02D 39/10; F04B 17/00

[58] Field of Search ..... 123/46 SC, 46 R; 417/380, 396, 364

[56] References Cited

UNITED STATES PATENTS

| | | | |
|---|---|---|---|
| 2,189,497 | 2/1940 | Pescars | 123/46 R |
| 2,215,326 | 9/1940 | Janicke | 123/46 R |
| 2,420,426 | 5/1947 | Harrer | 123/46 R |
| 2,478,375 | 8/1949 | Davis | 123/46 R |
| 2,565,849 | 8/1951 | Huber | 123/46 SC |
| 2,659,194 | 1/1953 | Huber | 123/46 SC |
| 2,666,569 | 1/1954 | Bent | 123/46 R |
| 2,701,555 | 2/1955 | Huber | 123/46 SC |
| 3,092,958 | 6/1963 | Duncan | 123/46 R |
| 3,610,214 | 10/1971 | Braun | 417/364 |

FOREIGN PATENTS OR APPLICATIONS

| | | | |
|---|---|---|---|
| 787,715 | 9/1935 | France | 123/46 R |
| 2,201,725 | 4/1974 | France | |

*Primary Examiner*—Carlton R. Croyle
*Assistant Examiner*—Thomas I. Ross
*Attorney, Agent, or Firm*—Sughrue, Rothwell, Mion, Zinn and Macpeak

[57] ABSTRACT

A variable stroke alternating compressor is disclosed wherein a movable one-piece free piston 1 serves at the same time as an engine piston 2, a compressor piston 3, and a bounce piston 4; the elements are integrated; the assembly is dynamically balanced, cooled, and insulated. It has no movable mechanical connections. The elements thereof have motions which are all controlled by the travel of the free piston.

8 Claims, 3 Drawing Figures

DIRECT ACTION COMPRESSOR FITTED WITH A ONE-PIECE PISTON

This application is a continuation-in-part of Ser. No. 377,010 filed on July 6, 1973, now abandoned.

BACKGROUND OF THE INVENTION

1. Field of the Invention

The present invention relates to a variable stroke compressor, which constitutes, together with its fittings, a compact unit. It is driven by a two-stroke Diesel engine.

2. Description of the Prior Art

Free piston compressors are known, which are constituted by two movable and identical members. The chief drawbacks of such compressors are the heaviness and complexity thereof, and the space taken up thereby. Devices are also known, which are constituted by a single set of several pistons, but said devices are not suitable for engines which use gas/oil mixture, such as two-cycle engines, and the cooling thereof is not satisfactory. The applications therefor are few.

SUMMARY OF THE INVENTION

The object of the present invention is to obviate such drawbacks and provide a self-contained machine which is complete while remaining light, and the design of which does not limit the industrial use thereof.

A machine according to the invention includes a motor unit, a compressor unit, and a drive unit for the auxiliaries, and is characterized in that, owing to the fact that the cylinders of said three units have the same longitudinal axis, a single movable one-piece member with no mechanical connection, and including essentially four useful faces, moves within the cylinders, the alternating translation of said member ensuring the operation of the auxiliaries, the engine, and the compressor simultaneously.

According to another feature of the invention, the movable member is constituted by a piston, one of the ends of which moves within the motor cylinder, and the other end of which moves within the drive cylinder for the auxiliaries, which is called the "bounce" cylinder, while the middle portion, the diameter of which is greater than that of each end, is movable within the double-acting compressor cylinder, said member being designed in a manner such that the transverse outer face of the first end portion acts as a driving piston, the opposite end portion constitutes a "bounce" piston, is used for storing compressed air, that transverse face of the middle portion which is directed towards the engine constitutes the piston of a pump for admitting air to the engine, and the other face of said middle portion ensures the delivery of compressed air.

According to another feature of the invention, the piston may be rotated due to the action of the cooling air through the ports provided in the head of the piston which may be inclined with respect to the radial axis.

According to another feature of the invention, the engine case is provided with cooling vanes over the whole of the circumference thereof, near that end of the cylinder where the combustion takes place, a similar arrangement of vanes being mounted on the outside of another one-piece case which carries the starting aids for the engine and the delivery tank for the compressed air, so that the compressor unit can be efficiently air-cooled.

According to another feature of the invention, the bounce cylinder is surrounded by an annular cooling chamber inside which a cold liquid flows, whereby the air cooling is improved.

According to another feature of the invention, a turbine mounted at the end of the exhaust pipe for the gases burnt in the engine is connected to the axis of a blower which ensures the circulation of fresh cooling air.

According to another feature of the invention, the engine case, on the one hand, and the one-piece case of the delivery tank, on the other hand, are interconnected by at least two steel stays, said stays being used as axes for the sliding of the weights which constitute the dynamic balancing system.

According to another feature of the invention, a gate is disposed at the end, and along the axis of the bounce cylinder upon which the group of accessories opens in a perpendicular direction, said group including, in particular, the fuel injection pump and the lubricating pump.

According to another feature of the invention, the one-piece case defines about the gate or valve first a starting chamber containing pressurized air, then a storing chamber for said pressurized air, and lastly, between the latter and the compressor cylinder, the delivery chamber for the compressed air; all these chambers, which are cylindrical or annular, have the same axis as the cylinders.

According to another feature of the invention, the injection, lubrication, and start systems are pneumatically controlled by the air compressed in the bounce cylinder, or the pressurized air stored in the chambers.

According to another feature of the invention, all the parts thus defined, to wit, engine, compressor, balancing system, cooling system, starter, admission and exhaust chamber, chambers for air storing, group of accessories . . . , form an integrated unit, that is, taking up little space, and the structure has only a minimum number of mechanical connections, so that the assembly is light.

According to another feature of the invention, and owing to said compaction of the elements, the unit can be covered with a sound insulating shell having a plain structure, which is constituted, for instance, by two elements interconnected through an air filter which protects the assembly.

BRIEF DESCRIPTION OF THE DRAWINGS

In the drawings.

The appended drawing, given by way of non-limiting example, will enable the features of the invention to be more clearly understood.

DETAILED DESCRIPTION OF THE INVENTION

Figure 1:
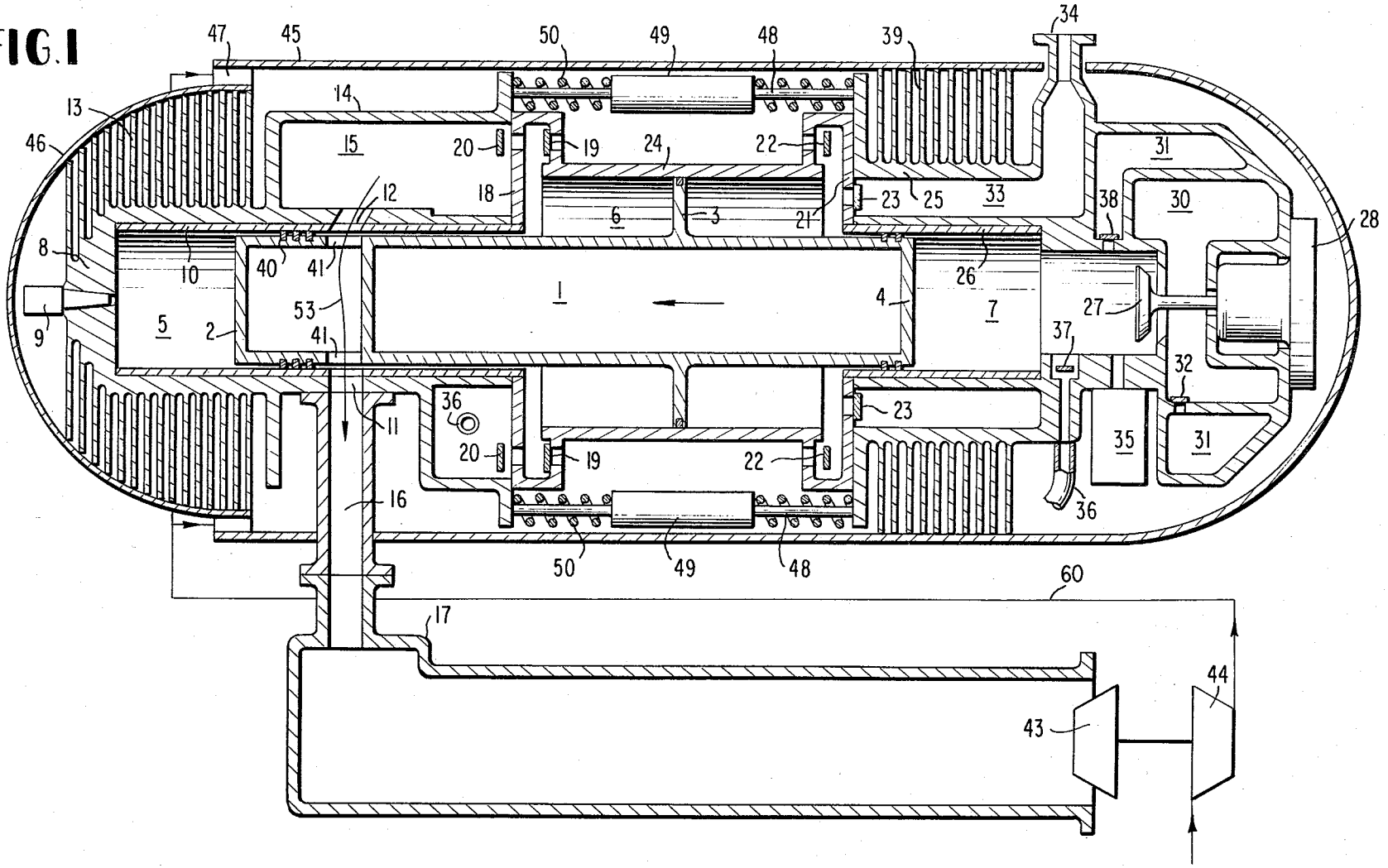
FIG. 1 is a longitudinal section of the compressor of the invention upon starting.

The machine is constituted by a single movable free piston 1, a first end portion 2 of which slides within the engine cylinder 5, the second end portion 4 of which slides within the bounce cylinder 7, while the middle third portion 3 of which slides within the compressor cylinder 6, which is a double-action cylinder.

The engine cylinder 5 includes namely a cylinder head 8 in which a fuel injector 9 and an inner liner 10 are provided. Exhaust and admission ports 11 and 12 open also into the cylinder. The outside of the cylinder is provided with vanes 13 for air cooling. Said engine cylinder 5 is mounted at the end of a case 14 which defines an admission chamber 15 for the gases through the port 12, while the exhaust port 11 open into a channel 16 which is in turn connected to the exhaust system 17. Although only a single admission port 12 and a single exhaust port are shown for illustrative purposes, obviously any number of admission and exhaust ports may be utilized within the scope of this invention.

The compressor cylinder 6 includes:

on the engine side, a generally circular plate 18 in which apertures are formed, said apertures being obturated by suction valves 19 and exhaust valves 20;

on the compression and delivery side, a similar plate 21 which carries suction valves 22 and exhaust valves 23, said valves (suction and exhaust) being removable;

a compressor liner 24 which connects the plates 18 and 21.

The plate 18 bears upon the case 14 and the cylinder head 8, while the plate 21 bears upon a one-piece case 25.

The bounce cylinder 7 lies within the case 25; it includes a liner 26, and its end includes a port obturated by a quick-opening valve 27 which is actuated by a pneumatic actuator 28. Opening said valve 27 allows the communication of the starting chamber 30 with the bounce cylinder 7 at the right time. The pneumatic operating actuator 28, per se, forms no part of the instant invention and any such mechanism may be utilized to open valve 27. A typical pneumatic mechanism is shown in French Patent 2,201,725. A storing chamber 31 for storing starting air is disposed around the starting chamber 30, said two chambers being interconnected through a valve 32 which the operator can open upon starting.

The case 25 contains also the delivery chamber 33 for the compressed air delivered, which supplies compressed air to the tools or gears of utilization (not shown) connected at port 34.

The group 35 of accessories is supplied compressed air through the "bounce" cylinder 7, the latter being in turn supplied by the line 36 having one end connected to admission chamber 15 and the non-return valve 37 bringing the air from the admission chamber 15. The "bounce" cylinder 7 supplies the storing chamber 31 with air through the delivery valve 38. Lastly, the cooler 39 ensures the cooling of the compressed air which comes out of the line 34.

The free piston 1 includes a first end portion 2, which constitutes the driving piston, and is fitted with compression rings 40 and ports 41 for the cooling, a second end portion 4, which constitutes the "bounce" piston, and the middle portion 3, which constitutes both the compressor piston, on the "bounce" side, and the scavenging pump, on the engine side.

The exhaust system 17 opens into a gas turbine 43 connected to the axis of a blowing means 44, which ensures the circulation of fresh air inside the insulating shell made up of two elements 45 and 46 which are in turn interconnected by the air filter 47 which protects the assembly. Typical blowing means which may be utilized in conjunction with the invention are shown in French Patent 2,202,536.

The cases 14 and 25 are interconnected by steel stays 48. Said stays serve as guides for the sliding of the dynamic balancing systems made of weights 49 and springs 50.

Figure 2:
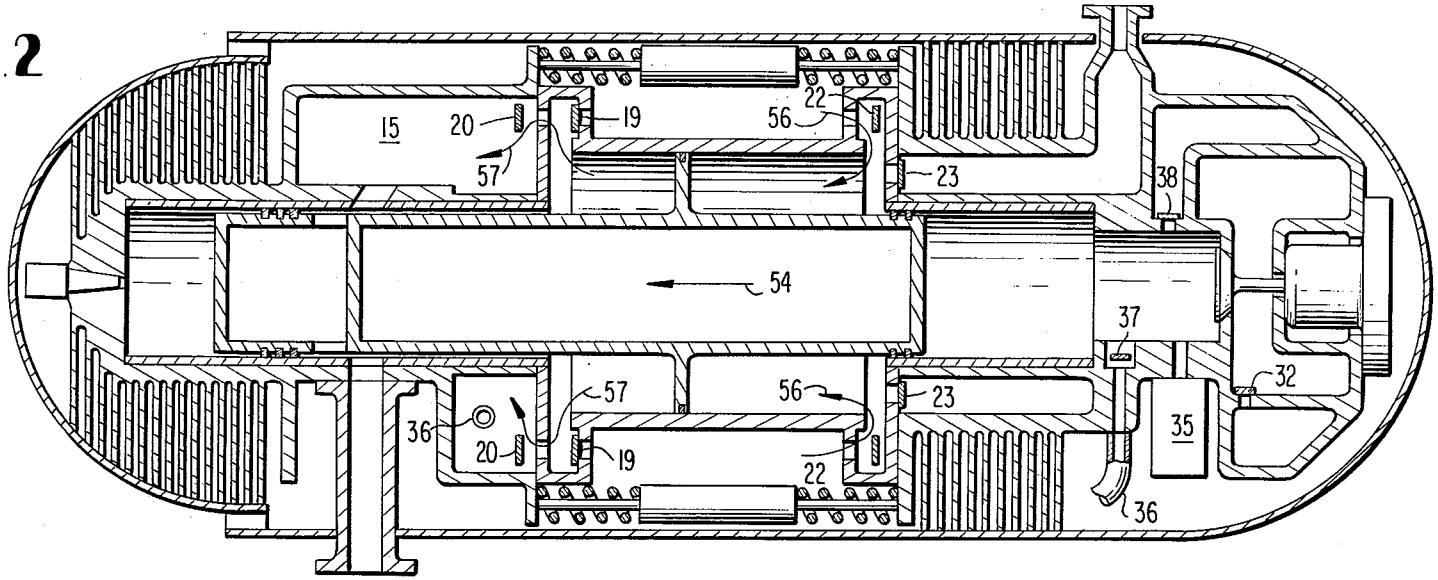
FIG. 2 is a section of the assembly during the compression-combustion stage.
Figure 3:
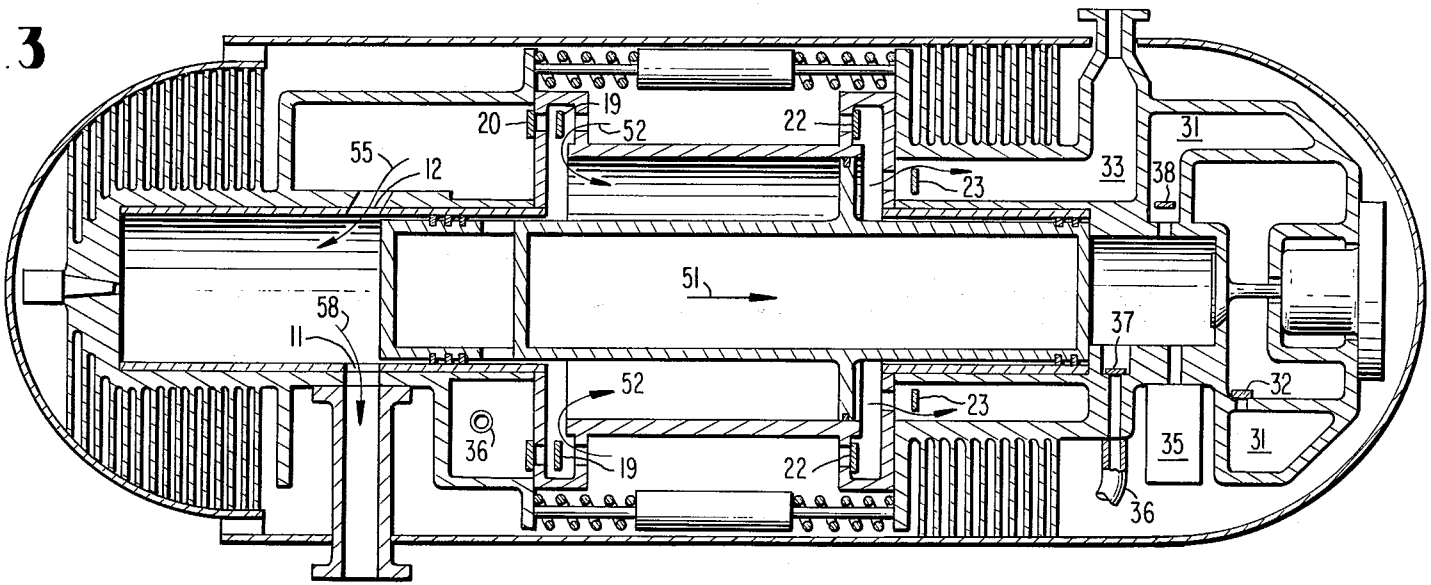
FIG. 3 is a section of the assembly during the expansion-admission stage.

The operation is as follows:

When the member 1 has compressed the air in the engine cylinder 5, the fuel is fed through the aperture of the injector 9 (FIG. 2). Combustion pushes the free piston to the right (FIG. 3) in the direction of the arrow 51. The volume of the compression cylinder 6 on the engine side increases and air is sucked thereinto, in the direction of the arrows 52, through the valves 19. At the same time the air enclosed in the compressor on the compression side of portion 3 is compressed and then delivered into the delivery chamber 33 through the valves 23. Simultaneously, the air enclosed in the bounce cylinder is compressed. It actuates the group 35 of accessories, on the one hand, while a portion of said air is delivered by the valve 38 and is stored inside the chamber 31 (FIG. 3). Towards the end of the stroke, the cooling ports 41 come opposite the admission port 12 and the exhaust port 11 of the engine cylinder. The air can then circulate inside the driving piston 2 and cool same, in the direction of the arrow 53, before flowing into the exhaust channel 16 (FIG. 1) wherein the gases burnt during the combustion then flow (FIG. 3). Said gases escape through the ports 11 when the member 1 reaches its farthest position. At the same time, the port 12 is open into the engine cylinder, and compressed air enters the combustion chamber from admission chamber 15.

Under the action of the pressure exerted by the compressed air in the "bounce" cylinder 7, the free piston 1 changes its direction of travel and follows the arrow 54 (FIG. 2). At the beginning of this motion, the air in the chamber 15 is admitted into the engine cylinder in the direction of the arrow 55 (FIG. 3); then, the motion of the piston results in:

the expansion of the air contained in the bounce chamber;

the expansion of the air in the compression side of compression cylinder 6, the consequent opening of the valves 22, and the admission of fresh air into the compression cylinder 6. Such admission takes place in the direction of the arrows 56;

a decrease in the volume on the engine side of portion 3, and thus the delivery of the air to the admission chamber 15, and consequently the cooling of the internal parts of the engine unit. The air is thus delivered while the port 12 are closed by the engine piston 2, and passes, in the direction of the arrows 57, through the apertures in the plate 18, which apertures are cleared by the valves 20 (FIG. 2).

When the air thus admitted into the engine cylinder 5 is compressed, the cycle starts again. The "bounce" cylinder 7 is supplied from admission chamber 15 via line 36 when the piston is in its left-hand side position, that is, when the pressure in the "bounce" cylinder 7 is low and the pressure in the admission chamber 15 is high.

For starting the engine, the movable member 1 is disposed at its utmost right-hand side position. Upon opening valve 32, the compressed air flows from the storage chamber 31 into the starting chamber 30. As soon as the starting pressure is reached, the actuator 28 opens the valve 27 quickly and allows the air accumulated in the starting chamber 30 to enter the "bounce" cylinder 7. The energy of said air launches the free piston towards the left, and ensures the first combustion.

For the equilibration, the balancing systems constituted by the stays 48 weights 49 and the springs 50 have a frequency calculated in a manner such that the weights 49 sliding along stays 48 beat in opposition of phase with respect to the free piston 1, whereby the assembly of the cases receives two equal; and opposed impulses, that of the movable member and that of the equilibrating means. Provision is made so that, in spite of a slight variation in the frequency of the machine, the system remains operational, that is, keeps operating properly.

As the exhaust gases (arrow 58, FIG. 3) and the scavenging air reach the exhaust system 17, the kinetic energy thereof is transmitted to the gas turbine 43 which drives a blower 44. Said blower provides the cooling systems 13 and 39 with a substantial amount of fresh air purified through the filter 47 by way of duct 60.

The machine according to the invention takes up little space. The power to weight ratio is higher than in the known devices. The powerful cooling, the efficient balancing system, the structure adapted to decrease the noises and pollution, the simple nature of the elements make it possible to enlarge the fields of application and reduce the working restraints.

What we claim is:

1. A free piston compressor comprising:

a. a compressor housing:

b. an engine cylinder affixed to and located within said housing, said engine cylinder having intake and exhaust means, and ignition means therein;

c. a bounce cylinder affixed to and located within said housing;

d. a compressor cylinder affixed to and located within said housing; said cylinder having an air inlet an air outlet;

e. a single free piston having a first portion slidingly engaging said engine cylinder, a second portion slidingly engaging said bounce cylinder and a third portion slidingly engaging said compressor cylinder;

f. means defining an admission chamber within said housing and communicating with said engine cylinder intake;

g. first valve means through said admission chamber defining means operable to allow passage of air from said compressor cylinder into said admission chamber during the compression stroke of said free piston first portion;

h. means defining a delivery chamber with said housing;

i. second valve means through said delivery chamber defining means to allow passage of compressed air from said compressor cylinder into said delivery chamber during the power stroke of the free piston first portion;

j. means defining a storing chamber within said housing;

k. third valve means to selectively allow the passage of air from said bounce cylinder into said storing chamber;

l. means defining a starting chamber within said housing;

m. fourth valve means to selectively allow the passage of air from said storing chamber into said starting chamber; and n. fifth valve means to selectively allow passage of air from said starting chamber into said bounce cylinder.

2. The free piston compressor of claim 1 wherein said first portion of said free piston has port means therethrough which communicate with said intake and exhaust means in said engine cylinder during a portion of the stroke of the free piston to allow passage of air from said admission chamber therethrough to cool said first portion.

3. The free piston compressor of claim 1 further comprising:

a. first air cooling vanes attached to the outer periphery of said engine cylinder; and b. second air cooling vanes attached to said compression cylinder.

4. The free piston compressor of claim 3 further comprising:

a. a gas driven turbine having an output shaft;

b. a blower operatively connected to said gas turbine output shaft;

c. means connecting said blower to said first and second cooling vanes so as to direct air from said blower through said cooling vanes; and d. means connecting the turbine with said engine cylinder exhaust means so as to direct the exhaust gases into said turbine and drive same.

5. The free piston compressor of claim 1 further comprising means connecting said bounce cylinder with compressor accessories, such as lubrication pumps and fuel injection means, to direct compressed air from said bounce cylinder to said accessories to provide the source of power for operating said accessories.

6. The free piston compression of claim 1 wherein the outer diameter of said third portion of said free piston is larger than the outer diameters of the first and second portions.

7. The free piston compressor of claim 6 wherein said first portion and said second portion of said free piston are located on opposite sides of said third portion.

8. The free piston compressor of claim 1 wherein said engine cylinder, said bounce cylinder and said compressor cylinder are coaxially located within said housing.

* * * * *